US006011459A

United States Patent [19]

Kobayashi et al.

[11] Patent Number: 6,011,459

[45] **Date of Patent: *Jan. 4, 2000**

[54] VOLTAGE-DEPENDENT NON-LINEAR RESISTOR MEMBER, METHOD FOR PRODUCING THE SAME AND ARRESTER

[75] Inventors: Kei-Ichiro Kobayashi; Tomoaki Kato; Yoshio Takada; Osamu Wada; Masahiro Kobayashi; Naomi Furuse; Yukio Fujiwara; Shoichi Shichimiya; Shinji Ishibe, all of Tokyo, Japan

[73] Assignee: Mitsubishi Denki Kabushiki Kaisha, Tokyo, Japan

[ * ] Notice: This patent is subject to a terminal disclaimer.

[21] Appl. No.: 09/252,986

[22] Filed: Feb. 19, 1999

Related U.S. Application Data

[63] Continuation of application No. 08/813,594, Mar. 7, 1997, Pat. No. 5,910,761.

[30] Foreign Application Priority Data

Apr. 23, 1996 [JP] Japan ..... 8-101202
Sep. 13, 1996 [JP] Japan ..... 8-243746

[51] Int. Cl.[7] ..... H01C 7/10

[52] U.S. Cl. ..... 338/21; 338/21; 252/519.51; 252/521.1

[58] Field of Search ..... 338/20, 21; 252/519.51, 252/521.1

[56] References Cited

U.S. PATENT DOCUMENTS

| | | | |
|---|---|---|---|
| 4,472,296 | 9/1984 | Hunter, Jr. et al. | 64/61 |
| 4,730,179 | 3/1988 | Nakata et al. | 338/20 |
| 4,736,183 | 4/1988 | Yamazaki et al. | 338/20 |
| 4,855,708 | 8/1989 | Nakata et al. | 338/20 |
| 4,920,328 | 4/1990 | Hayashi et al. | 338/21 |
| 4,933,659 | 6/1990 | Imai et al. | 338/20 |
| 5,138,298 | 8/1992 | Shino | 338/21 |
| 5,248,452 | 9/1993 | Imai et al. | 252/518 |
| 5,592,140 | 1/1997 | Tokunaga et al. | 338/21 |
| 5,640,136 | 6/1997 | Yodogawa et al. | 338/20 |
| 5,739,742 | 4/1998 | Iga et al. | 338/21 |
| 5,807,510 | 9/1998 | Furuse et al. | 338/21 |

FOREIGN PATENT DOCUMENTS

| | | | |
|---|---|---|---|
| 52-11756 | 11/1972 | Japan | 338/21 |
| 54-57699 | 5/1979 | Japan | 338/21 |
| 61-43404 | 3/1986 | Japan . | |
| 4-175259 | 6/1992 | Japan . | |
| 6-321617 | 11/1994 | Japan . | |
| 8-115805 | 5/1996 | Japan . | |

OTHER PUBLICATIONS

Journal of the American Ceramic Society, vol. 73, No. 7, "Application of Zinc Oxide Varistors" by Tapan Gupta, 1990.

J. Appl. Phy. 50(4), Apr. 1979, "Theory of Conduction in ZnO Varistors" by Mahan et al.

JP 61–43404 English Translation of Item L above; Kikuchi et al.

*Primary Examiner*—Michael L. Gellner
*Assistant Examiner*—Karl Easthom
*Attorney, Agent, or Firm*—Sughrue, Mion, Zinn, Macpeak & Seas, PLLC

[57] ABSTRACT

A voltage-dependent non-linear resistor member, a method for producing the same, and an arrester equipped with the same. The member is produced by a process comprising the addition of at least one oxide of a rare earth element selected from Y, Ho, Er and Yb in an amount of 0.05–1.0 mol % in terms of $R_2O_3$ to a composition which principally consists of zinc oxide and contains bismuth oxide. The member has excellent non-linearity and a high varistor valtage. Further, the arrester has very small size and improved protective properties.

4 Claims, 11 Drawing Sheets

1 : SPINEL GRAIN
2 : ZINC OXIDE GRAIN
3 : ZINC SILICATE GRAIN
4 : BISMUTH OXIDE
5 : Y-Bi-Sb COEXISTING OXIDE GRAIN
6 : TWINNING BOUNDARY

1 : SPINEL GRAIN

2 : ZINC OXIDE GRAIN

3 : ZINC SILICATE GRAIN

4 : BISMUTH OXIDE

5 : Y-Bi-Sb COEXISTING OXIDE GRAIN

6 : TWINNING BOUNDARY

1 : SPINEL GRAIN

2 : ZINC OXIDE GRAIN

3 : ZINC SILICATE GRAIN

4 : BISMUTH OXIDE

5 : Y-Bi-Sb COEXISTING OXIDE GRAIN

6 : TWINNING BOUNDARY

VOLTAGE-DEPENDENT NON-LINEAR RESISTOR MEMBER, METHOD FOR PRODUCING THE SAME AND ARRESTER

This is a continuation of Application Ser. No. 08/813,594 filed Mar. 7, 1997, now U.S. Pat. No. 5,910,761 the disclosure of which is incorporated herein by reference.

BACKGROUND OF THE INVENTION

1. Field of the Invention

The present invention relates to a voltage-dependent non-linear resistor member, a method for producing the same and an arrester equipped with the member. More specifically, the present invention relates to a voltage-dependent non-linear resistor member and a method for producing the same, wherein the resistor member comprises a sintered material, the principal ingredient of which is zinc oxide, and is practically available for the material of an arrester, a surge absorber, and others.

2. Description of the Related Arts

Conventionally, a voltage-dependent non-linear resistor member which principally consists of zinc oxide and is used as an arrester and the like comprises a sintered material produced by means of granulation, compacting, and burning from a mixed composition of zinc oxide which is the principal ingredient, bismuth oxide which is considered as essential to expression of voltage-dependent non-linear resistance, and other additives which are effective for improvement of electric properties. Further, the sintered material is provided with a high-resistance side layer and electrodes comprising metal aluminum and/or the like to make up the resistor member (see; FIG. 6).

FIG. 7 is a schematic drawing illustrating a micro-structure of a part of crystal structure of an ordinary voltage-dependent non-linear resistor member. In the figure, the numeral 1 indicates spinel grains mainly constituted by zinc and antimony, 2 indicates zinc oxide grains, 3 indicates zinc silicate, $Zn_2SiO_4$, 4 indicates bismuth oxide, and 6 indicates twinning boundaries in zinc oxide crystal grains. Specifically, the spinel grain principally consisting of zinc and antimony may take either of two existing states in the structure, namely, some spinel grains exist surrounded by zinc oxide grains 2, while others exist near triple points (multiple points) of zinc oxide grains. Further, some of bismuth oxide 4 exist at the boundaries of zinc oxide grains 2 as well as at the multiple points.

An experiment using point electrodes has revealed that a grain itself which principally consists of zinc oxide functions as a mere resistive substance while exhibiting voltage-dependent non-linearity at the boundary portion between the zinc oxide grain 2 and another zinc oxide grain 2 (G. D. Mahan, L. M. Levinson & H. R. Philipp, "Theory of conduction in ZnO varistors", J. Appl. Phys. 50 [4], 2799 (1979); hereinafter referred to as Reference 1). Additionally, it is also experimentally confirmed that the number of the boundary portion between zinc oxide grain-zinc oxide grain (grain boundary) determines the varistor voltage (T. K. Gupta, "Application of Zinc Oxide Varistors", J. Am. Ceram. Soc., 73 [7], 1817–1840; hereinafter referred to as Reference 2; or others).

FIG. 8 is a diagram showing a voltage-current characteristic (non-linearity characteristic) of an ordinary voltage-dependent non-linear resistor member having the above-described micro-structure.

Zinc oxide voltage-dependent non-linear resistor members having excellent protective performance possess a small $V_H/V_L$ ratio (limit voltage ratio, or flatness ratio), wherein $V_H$ and $V_L$ are values of voltages at a large-current region and a small-current region in FIG. 8, respectively. When improvement in limit voltage ratio is discussed, the limit voltage ratios in the large-current region and the small-current region should be each individually discussed since the factor which determines the limit voltage ratio in one of said regions is different from the factor which determines the limit voltage in the other region. Therefore, hereinafter, the limit voltage ratio $V_H/V_L$ is separately discussed using the voltage, $V_S$ at S of FIG. 8 in each view of the flatness ratio in the large-current region $V_H/V_S$ or the flatness ratio in the small-current region $V_L/V_S$, respectively.

As to the flatness ratio in a large-current region $V_H/V_S$, $V_H$ is believed to be determined by internal resistivity of a zinc oxide crystal grains (References 1 and 2). $V_H$ decreases in accordance with decrease in the internal resistivity of a zinc oxide crystal grain, and therefore, $V_H/V_S$ would be also smaller. On the other hand, the flatness ratio in a small-current region $V_S/V_L$ is believe to be determined by a Schottky barrier which is considered to be formed at the grain boundary between zinc oxide crystals (References 1 and 2). As the apparent resistivity at the grain boundary between zinc oxide crystals becomes large, $V_S/V_L$ becomes smaller. Accordingly, it is suggested that internal resistivity in a zinc oxide grain should be decreased and apparent resistivity at the grain boundary between zinc oxide crystals should be enhanced to improve the discharge voltage, $V_H/V_L$.

The $V_S$ indicated in FIG. 8 is the non-linear threshold voltage in voltage-dependent non-linear resistor members. The value of $V_S$ is determined corresponding to the transmission system to which an arrestor is applied. In many cases, $V_{3\ mA}$ is used as a typical value for $V_S$, wherein $V_{3\ mA}$ is an inter-electrode voltage between both ends of a device when 3 mA of electric current is applied to the device. Taking account of the size of the device, the current value of 3 mA equals approximately 50 $\mu A/cm^2$ of current density. The $V_S$ value of a zinc oxide device is in proportion to the thickness of the device.

In apparatus used with a high system voltage, for example, an arrestor used for electrical power transmission at UHV 1 MV, the number of series-laminated devices increases when devices which have a uniform shape and a $V_S$ value similar to that of conventional devices are laminated. As a result, the size of the arrestor becomes large, and the mode for series connection will be complicated, and therefore, many problems arise in relation to electrical matters, thermal matters, and mechanical design. Accordingly, these problems can be solved if a device which has a large $V_S$ value per unit length (for example, $V_{3\ mA}$/mm: varistor voltage) is available, since the distributed voltage per device becomes high and the number of series-laminated devices can be reduced. Here, $V_S$ value per unit length is calculated by dividing the $V_S$ value by the thickness value of the device.

A prior investigation has revealed that the factor which controls $V_S$ value is the sizes of zinc oxide grains 2 in the crystal structure of a device shown in FIG. 7 (Reference 2). The region around 3 mA is the non-linear region in the voltage-current characteristic shown in FIG. 8, and the below-described equation I holds true experimentally:

$$V_{3\ mA}/\text{mm}=k/D \qquad \text{I,}$$

wherein k is a constant and D is a mean grain size of zinc oxide. Accordingly, 1/D equals the number of grain boundaries between zinc oxide grains per unit length, Ng. The above equation I can be thus expressed as the below-described equation II.

$$V_{3\,mA}/mm = k'D \qquad \text{II}$$

It is obvious that the constant k' represents the varistor voltage per grain boundary of the zinc oxide device (Reference 2).

In summary, at least two requirements as follows can be listed to accomplish excellent protective properties:

i) as to the electrical properties of the varistor, limit voltage ratio, $V_H/V_L$ is small; and, ii) as to the electrical properties required of a voltage-dependent non-linear resistor member for a practicable arrestor having a compact size, the varistor voltage is made large. Additionally, when the shape of the device is the same as that of conventional one, it is naturally required to have a large value of energy bearing capacity in proportion as the varistor voltage of the device increases. Since the factor which determines the protective properties of arrestors is relative to the above-described i), it is particularly required to reduce the limit voltage ratio by improving the composition of the voltage-dependent non-linear resistor member and/or process for producing the same. Further, since the factors which determine the features of the arrestor such as size are relative to the above-described ii), it is particularly required to render the varistor voltage large.

The present invention has been achieved to solve the above-described problems. Therefore, an object of the present invention is to provide a voltage-dependent non-linear resistor member, a method for producing the same, and an arrester equipped with the same wherein the resistor member has high varistor voltage and small limit voltage ratios, namely, excellent flatness ratios throughout the large- and small-current regions. Further, another object of the present invention is to provide a voltage-dependent non-linear resistor member having a large varistor voltage and a method for producing the same.

SUMMARY OF THE INVENTION

The present invention provides a voltage-dependent non-linear resistor member obtainable by a process comprising the adding at least one oxide of a rare earth element R selected from Y, Ho, Er and Yb in an amount of 0.05–1.0 mol % in terms of $R_2O_3$ to a composition which principally consists of zinc oxide and contains bismuth oxide, and subsequent burning.

Further, the present invention provides the member wherein Al in an amount of 0.0005–0.005 mol % in terms of $Al_2O_3$ is further added.

Furthermore, the present invention provides the member wherein Al in an amount of 0.0005–0.005 mol % in terms of $Al_2O_3$ is further added.

Still further, the present invention provides the member wherein Sb and Si are further added to the composition, and the sintered material includes oxide grains composed of R (rare earth element), Bi and Sb, and crystal grains of zinc silicate, $Zn_2SiO_4$.

Yet further, the present invention provides the member wherein Sb, Si and Mn are further added to the composition, and the sintered material includes oxide grains composed of R (rare earth element), Bi, Sb, Zn and Mn, and crystal grains of zinc silicate, $Zn_2SiO_4$.

Further, the present invention provides the member characterized in that the composition of oxide grains respectively composed of R (rare earth element), Bi, Sb, Zn and Mn is 20.7–39.3, 4.8–10.8, 24.8–33.2, 31.7–40.7, 0.6–2.0 mol %, in terms of $Y_2O_3$, $Bi_2O_3$, $Sb_2O_3$, ZnO, $Mn_3O_4$, respectively.

Furthermore, the present invention provides a method for producing the above voltage-dependent non-linear resistor member comprising conducting first burning of the member and conducting second burning of the resultant, wherein the first burning step is carried out on exposure to air, and an annealing process with a temperature descending gradient of 5° C./hour or less or a heat retaining process at a constant temperature is contained, and further, the annealing process or heat retaining process is performed in an atmosphere of 50 vol % or more of oxygen.

Still further, the present invention provides an arrester equipped with the above voltage-dependent non-linear resistor member.

Yet further, the present invention provides the arrester obtainable by a method comprising conducting first burning of the member and conducting second burning of the resultant, wherein the first burning step is carried out on exposure to air, and an annealing process with a temperature descending gradient of 5° C./hour or less or a heat retaining process at a constant temperature is contained, and further, the annealing process and/or heat retaining process is performed in an atmosphere of 50 vol % or more of oxygen.

DETAILED DESCRIPTION OF THE INVENTION

Figure 1:
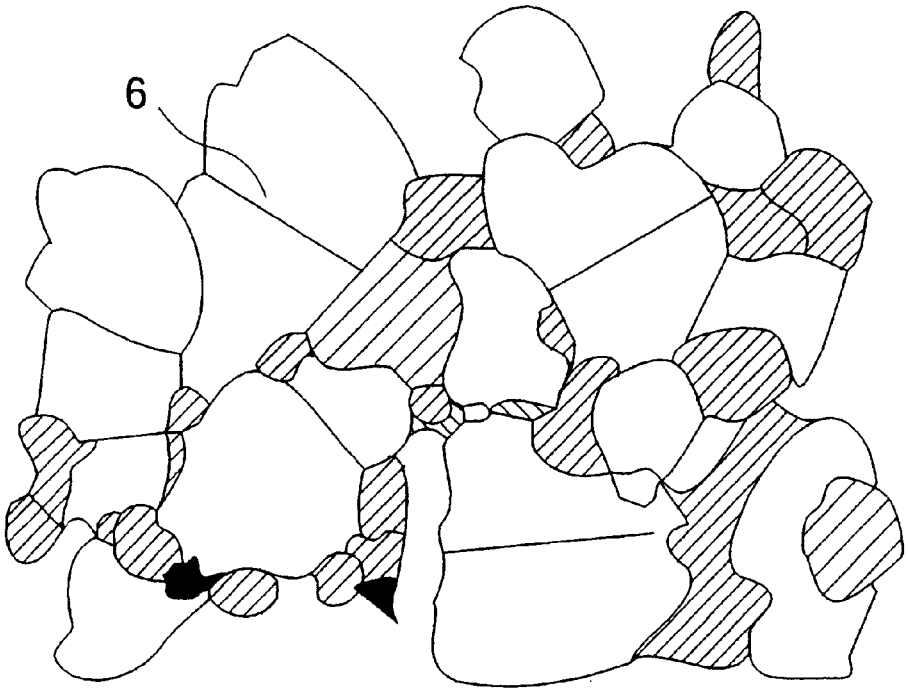
FIG. 1 is a schematic diagram illustrating a partial microstructure of the crystal structure of a voltage-dependent non-linear resistor member in relation to Examples of the present invention.

In relation to the present invention, the content of the principal ingredient, zinc oxide in the raw material may preferably be adjusted to be 90–97 mol %, particularly 92–96 mol % in terms of ZnO, for the purpose of improving the varistor voltage and voltage-dependent non-linearity.

Bismuth oxide to be used in the present invention may be in the form of particles having an average particle size of 1–10 $\mu$m. The content of bismuth oxide exceeding 5 mol % would reversely affect to the inhibitory effect on the granular growth of zinc oxide grains. On the other hand, with less than 0.1 mol %, leakage current would increase ($V_L$ would be small). For that reason, the content of bismuth oxide in the raw material of the voltage-dependent non-linear resistor member (hereinafter referred to merely as raw material) may preferably be adjusted to be 0.1–5 mol %, particularly 0.2–2 mol %.

Additionally, the voltage-dependent non-linear resistor member of the present invention may contain antimony oxide having a property to make the $V_S$ value large. The antimony generally used should be in the form of particles having an average particle size of 0.5–5 $\mu$m. The content of antimony oxide exceeding 5 mol % would make the varistor voltage large, but would increase the quantity of spinel grains as the resultant of reaction with zinc oxide, which severely restricts the current-carrying path, and thus increases inhomogeneity and makes the resistor member breakable. On the other hand, with less than 0.5 mol %, the inhibitory effect on the granular growth of zinc oxide grains cannot be sufficiently exhibited. For that reason, the content of antimony oxide in the raw material may preferably be adjusted to be 0.5–5 mol %, particularly 0.75–2 mol %.

Further, the voltage-dependent non-linear resistor member of the present invention may contain chromium oxide, nickel oxide, cobalt oxide, manganese oxide, and/or silicon oxide in order to improve the voltage-dependent non-linearity. These oxides may be in the forms of particles having average particle sizes of 10 $\mu$m or less. The content of these ingredients should preferably be adjusted to be 0.1 mol % or more, and more particularly 0.2 mol % or more, in terms of NiO, $Co_3O_4$, $Mn_3O_4$ and $SiO_2$, respectively. However, with the content exceeding 5 mol % or more, the quantities of substances in spinel phase, substances in pyrochlore phase (intermediates in the reaction generating the spinel phase) and zinc silicate increase, and therefore, the energy bearing capacity and voltage-dependent non-linearity tend to be reduced or deteriorated. For that reason, the content in the raw material should preferably be adjusted to be 0.1–5 mol %, and more particularly, 0.2–2 mol %.

In addition, the voltage-dependent non-linear resistor member of the present invention may contain 0.01–0.1 mol % of boric acid in the raw material in order to make the melting point of bismuth oxide lower, thus making its fluidity higher, and thereby making bismuth oxide effectively reduce pores which may exist between grains or so on.

Moreover, it is preferable to add at least one oxide of a rare earth element R selected from Y, Ho, Er and Yb to the voltage-dependent non-linear resistor member in an amount of 0.05–1.0 mol % in terms of $R_2O_3$, because granular growth of ZnO crystals can be inhibited and varistor voltage, $V_{3\ mA}$/mm can be increased. The addition of these oxides is preferable also because the flatness ratio in the large-current region, $V_H/V_S$ of the voltage-dependent non-linear resistor member to be obtained can be improved, and thus, non-linearity can also be improved. Because the rare earth elements have ionic radii larger than that of $Zn^{2+}$, they can not easily be substitutive for the Zn sites in ZnO grains, and are mainly segregated as pure crystal grains at the grain boundaries of ZnO crystals or inside of ZnO crystals. However, when an extremely small quantity is solid-solved in the ZnO crystal grains, trivalent ions of the above-described elements are substituted for divalent ions of Zn to reduce the resistance inside of the ZnO crystal grain by their electronic effects. As a result, the flatness ratio in the large-current region can be improved.

As the above-described oxides of rare earth elements, those having average particle sizes of 5 $\mu$m or less are usually used. With a content of the oxides of rare earth elements of more than 1.0 mol %, the $V_{3\ mA}$ value becomes large and the solid-solved portions of bismuth oxide-oxide of a rare earth element increase at the grain boundaries, and therefore, ZnO grains become too small. On the other hand, with a content of less than 0.05 mol %, the $V_{3\ mA}$ value of the voltage-dependent non-linear resistor member to be obtained does not significantly increase as compared with that without an addition of the oxides of rare earth elements, and further, the flatness ratio in the large-current region, $V_H/V_S$ cannot be reduced. For that reason, the content of oxides of rare earth elements in the raw material should preferably be adjusted to be 0.05–1.0 mol %, and more particularly 0.1–0.5 mol %.

Furthermore, the voltage-dependent non-linear resistor member of the present invention may contain 0.001–0.01 mol % of aluminum nitrate in order to reduce the electrical resistance of zinc oxide grains and improve the voltage-dependent non-linearity. Because aluminum ion has ionic radii smaller than that of $Zn^{2+}$, aluminum ions are solid-solved in ZnO grains to a permissive extent based on the lattice defect. Then, trivalent aluminum ions are substituted for divalent ions of Zn to reduce the resistance inside of the ZnO crystal grains by their electronic effects. As a result, the flatness ratio in the large-current region can be improved. The required content will be 0.0005–0.005 mol % in terms of $Al_2O_3$, because 1 mol % of aluminum nitrate, $Al(NO_3)_3$ corresponds to ½ mol % of $Al_2O_3$.

Additionally, in the voltage-dependent non-linear resistor member of the present invention, it is preferable that grains of oxides respectively containing R (a rare earth element), Bi and Sb, and grains of $Zn_2SiO_4$ crystal exist between or inside of the zinc oxide crystal grains. Among the voltage-dependent non-linear resistor members produced with the addition of various rare earth elements, the granular growth of ZnO crystals can be inhibited and the varistor voltage $V_{3\ mA}$/mm can be increased in such a resistor member in which grains of oxides respectively containing R, Bi and Sb, and grains of $Zn_2SiO_4$ crystal exist between or inside of the zinc oxide crystal grains in terms of observation with an EPMA (Electron Probe Micro Analyzer).

Further, in the voltage-dependent non-linear resistor member of the present invention, it is preferable that grains of oxides respectively containing R (a rare earth element), Bi, Sb, Zn and Mn, and grains of $Zn_2SiO_4$ crystal exist between or inside of the zinc oxide crystal grains. Among the voltage-dependent non-linear resistor members produced with the addition of various rare earth elements, the granular growth of ZnO crystals can be inhibited and the varistor voltage $V_{3\ mA}$/mm can be increased in such a resistor member in which grains of oxides respectively containing R, Bi, Sb, Zn and Mn, and grains of $Zn_2SiO_4$ crystal exist between or inside of the zinc oxide crystal grains in terms of observation with a transparent electron microscope (TEM) which has an analyzing function of EDS (Energy Dispersive X-ray Spectroscopy), EELS (Electron Energy Loss Spedtoscopy) or the like.

Moreover, in the voltage-dependent non-linear resistor member of the present invention, it is preferable that grains of oxides respectively containing R (a rare earth element), Bi, Sb, Zn and Mn, and grains of $Zn_2SiO_4$ crystal exist between or inside of the zinc oxide crystal grains, and that the composition of the grains of oxides respectively containing R (rare earth element), Bi, Sb, Zn and Mn is 20.7–39.3, 4.8–10.8, 24.8–33.2, 31.7–40.7, and 0.6–2.0 mol %, in terms of $Y_2O_3$, $Bi_2O_3$, $Sb_2O_3$, ZnO and $Mn_3O_4$, respectively. Among the voltage-dependent non-linear resistor members produced with the addition of various rare earth elements, the granular growth of ZnO crystals can be inhibited and the varistor voltage $V_{3\ mA}$/mm can be increased in such a resistor member in which grains of oxides respectively containing R, Bi, Sb, Zn and Mn, and grains of $Zn_2O_4$ crystal exist between or inside of the zinc oxide crystal grains in terms of observation with a transparent electron microscope (TEM) which has an analyzing function of EDS (Energy Dispersive X-ray Spectroscopy), EELS (Electron Energy Loss Spedtoscopy) or the like.

Next, a method for producing the voltage-dependent non-linear resistor member of the present invention which comprises the above-described raw material is specifically illustrated below.

After properly adjusting the average particle sizes, the above-described raw materials are made into a slurry by using, for example, a polyvinyl alcohol aqueous solution, and then dried and granulated with a spray drier and/or others in order to obtain granules suitable to compacting.

The granules thus obtained are subjected to uniaxial press with a pressure of, for example, about 200–500 kgf/cm$^2$ in order to form a compact having a predetermined shape. The compact is then pre-heated at a temperature of about 600° C. in order to remove the binder (polyvinyl alcohol) from the compact, and subjected to burning.

The burning step comprises the first burning step to be carried out on exposure to air and the second burning step to be carried out in an oxygen atmosphere. In varistors, homogeneity within a device itself obtained by sintering is very important as well as the overall electrical properties of the device. When the device itself is not homogeneous, heat generates in the device inhomogeneously because the electric current which flows in the device on occurrence of a surge becomes inhomogeneous, and thus the device may be damaged. When burning is performed in an oxygen atmosphere, the temperature ascending gradient should preferably be 10° C./hour or less. With a higher temperature ascending gradient, decomposition reaction of polyvinyl alcohol, which is added as a binder, progresses rapidly. As a result, the device would have inhomogeneity within itself, and in an extreme case, the device would have cavities inside thereof. Meanwhile, when burning is performed on exposure to air, sufficient homogeneity can be obtained within the device even if ascending heating is performed at a gradient of about 150° C./hour. For that reason, it has been determined to carry out burning separately in two steps, namely, burning on exposure to air which is excellent in homogeneity of the burning and mass-productivity is performed as the first burning step, and subsequently, the second burning step is performed in an oxygen atmosphere in order to improve non-linearity. In such a case, the highest temperature in the second step should be determined so as to be below that in the first step. Otherwise, sintering further progresses in the second burning step in an oxygen atmosphere while causing inhomogeneity within the device on account of growth of crystal grain. The following are the conditions for the second burning step which is performed in an oxygen atmosphere.

The second step contains an ascending heating process at a temperature ascending gradient of 10–400° C./hour, a heat retaining process for 1–25 hours in which the highest retaining temperature is 950° C. or more but below the burning temperature used in the first step, and subsequent thereto, an annealing process performed in the descending temperature range of 700–400° C. at the descending temperature gradient of 5° C./hour or less, or another heat retaining process at a constant temperature. In the description of examples and comparative examples, the samples obtained by burning at 1050° C. for 5 hours were subjected to various measurements and data thus obtained were listed. The burning conditions, while the first burning step is particularly regarded as a condition for homogenous and sufficient progress of the sintering reaction according to the solid phase reaction and for densification of the device, can be set by utilizing an X-ray diffractometer, a thermogravimeter (TG), a thermomechanical analyzer (TMA), and/or the like.

Hitherto, in many case, burning has been carried out on exposure to air. In the present invention, however, a condition set as a burning atmosphere containing 50 vol % or more of oxygen is applied at least to the annealing process or heat retaining process in the temperature descending process of the second burning step. In the case where the partial pressure of oxygen is determined, the remaining gas component is principally nitrogen. Here, by controlling the burning atmosphere, degrees of oxygen shortage both in zinc oxide crystal grains and at grain boundaries are controlled independently, and the density of conduction electrons as carriers of n-type semiconductor is controlled. As a result, the electric resistivities in the crystal grains and at the grain boundaries would be set at suitable values, and thus, flatness ratios in the large-current region and small-current region can be improved.

For the step in which the content of oxygen is 50 vol % or more, the preferred content of oxygen is 100 vol %. Generally, it is not easy to maintain a high and stable oxygen content in furnaces for burning to obtain voltage-dependent non-linear resistor members, even in batch type furnaces as well as in continuous furnaces. It is, therefore, preferable to set the oxygen content so as to be close to a 100% oxygen atmosphere, practically, so as to be 50 vol % or more, and more particularly, 80 vol % or more, for the step to be performed in 50 vol % or more of oxygen content. Incidentally, the above-described permissible setting ranges for oxygen content have been determined based on the results in examples and comparative examples shown in Table 6.

In the method for producing a voltage-dependent non-linear resistor member, it comprises conducting first burning of the member and conducting second burning of the resultant, wherein the first burning step is carried out on exposure to air, and an annealing process with a temperature descending gradient of 5° C./hour or less or a heat retaining process at a constant temperature is contained, and further, the annealing process or heat retaining process is performed in an atmosphere of 50 vol % or more of oxygen. The thus obtained has good homogeneous varistor properties and allows the flatness ratio in the small-current region to be decreased.

Further, the arrester equipped with the member of the present invention or the member obtained by conducting the present method makes itself small size and provides improvements of protective properties.

EXAMPLES

The voltage-dependent non-linear resistor member and the method for producing the same according to the present invention will be illustrated in detail based on examples as described below, but the present invention should not be limited to such examples.

The following basic composition and manufacturing procedure are adopted in each of the examples and comparative examples.

The contents of bismuth oxide, chromium oxide, nickel oxide, cobalt oxide, manganese oxide and silicon oxide are 0.5 mol %, and the content of antimony oxide is 1.2 mol %. The content of boric acid is adjusted to be 0.08 mol %. The balance is zinc oxide.

Other components necessary for each of the examples were added to the above-described basic composition to prepare a raw material. The raw material was mixed and ground with a ball mill, and then dried and granulated with a spray dryer. Granules thus obtained were subjected to uniaxial press compacting with a pressure of about 200–500 kgf/cm$^2$ to produce a compact of 130 mm in diameter and 30 mm in thickness.

Pre-heating was performed at 600° C. for 5 hours to remove the binder (polyvinyl alcohol) from the resultant compact.

As the first step, burning on exposure to air, which is excellent in burning homogeneity and mass-productivity, was carried out at 1100° C. for 5 hours.

Examples 1–16

Figure 5:
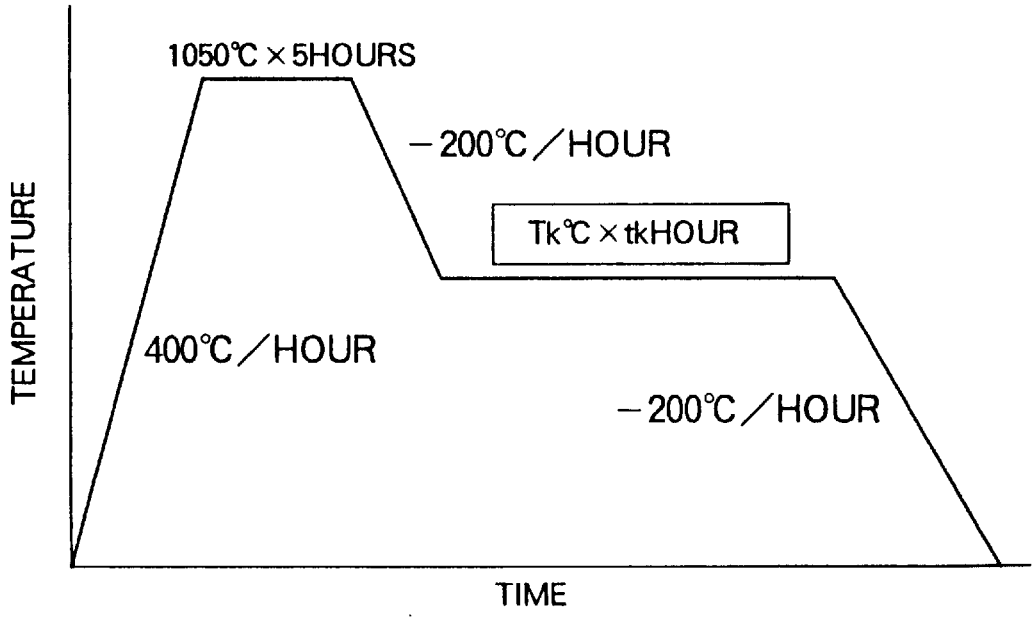
FIG. 5 shows the temperature profile used in the examination of burning conditions shown in Table 4.
Figure 6:
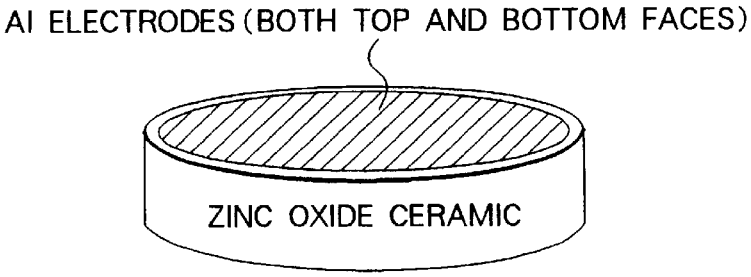
FIG. 6 is a schematic diagram illustrating the structure of an ordinary zinc oxide varistor.
Figure 7:
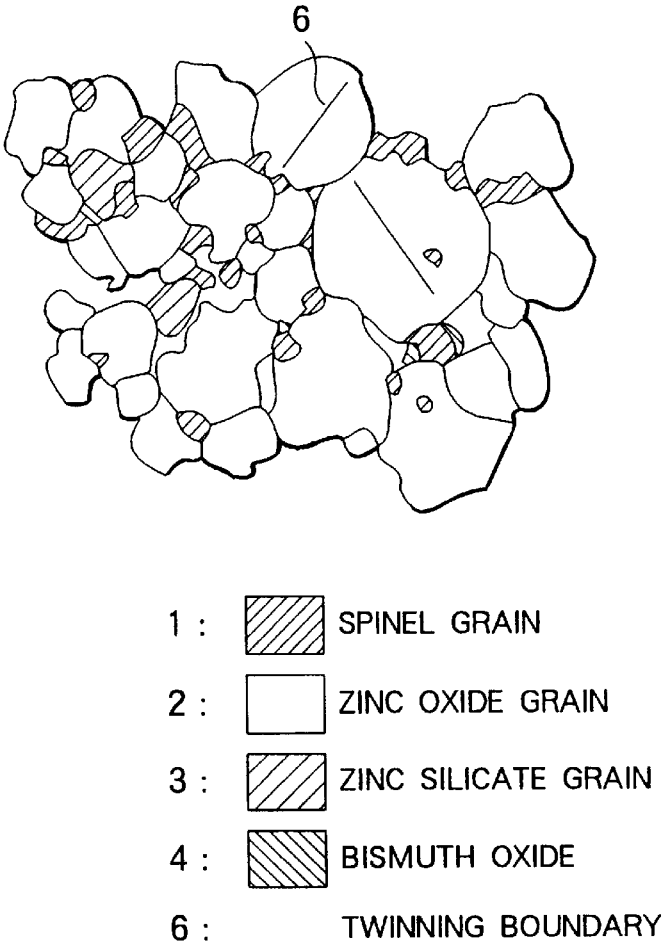
FIG. 7 is a schematic diagram illustrating a partial microstructure of the crystal structure of an ordinary voltage-dependent non-linear resistor member.
Figure 8:
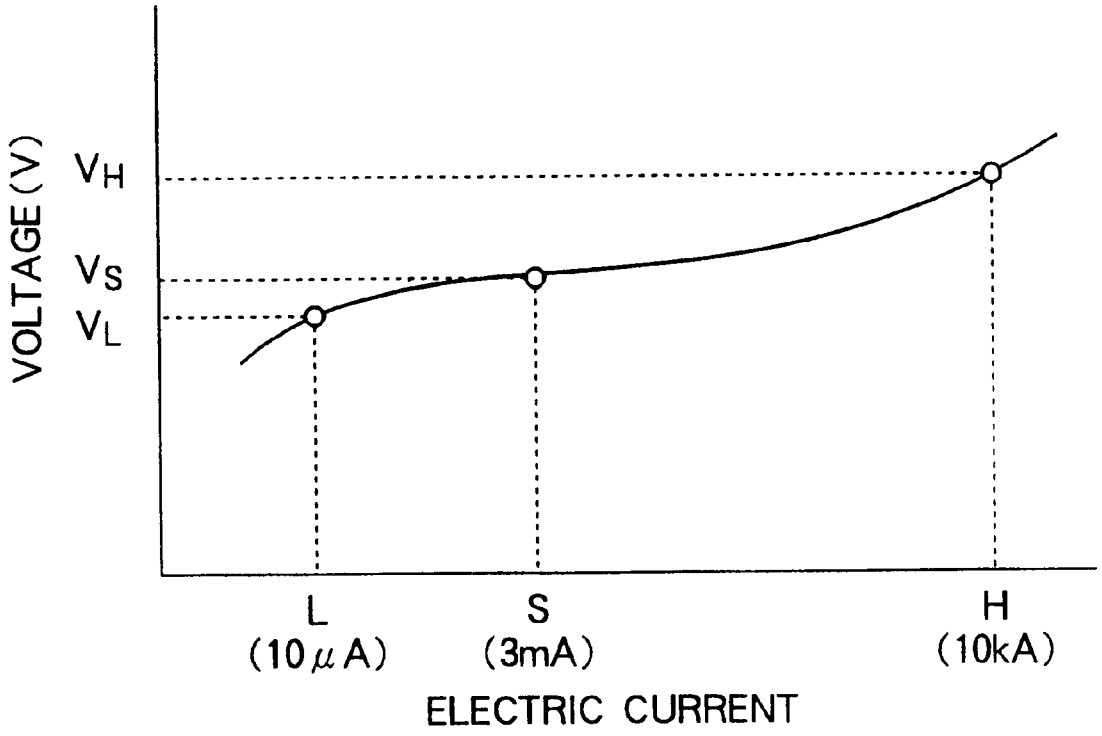
FIG. 8 is a characteristic diagram showing a voltage-current characteristic of an ordinary voltage-dependent non-linear resistor member.

As shown in Table 1, 0.05–1.0 mol % of oxides of rare earth elements, $Y_2O_3$, $Ho_2O_3$, $Er_2O_3$, and $Yb_2O_3$, were added to the above-described mixtures having the basic composition. The first burning step was performed on exposure to air, the burning in which is excellent in homogeneity and mass-productivity. After that, the second burning step was performed in an oxygen atmosphere to enhance non-linearity. Here, annealing was carried out in the temperature range of 700–500° C. at a descending gradient of 1° C./hour. The second burning step was performed with its temperature profiles being based on FIG. 5. Aluminum was added in the form of a nitrate aqueous solution in an amount of 0.004 mol %. Each of varistor voltages ($V_{3\ mA}$/mm) of samples thus obtained were in proportion with the content of $Y_2O_3$, $Ho_2O_3$, $Er_2O_3$, or $Yb_2O_3$. When the content is 1.0 mol %, mostly 50 V/mm or more of value can be obtained (Examples 4, 8, 12 and 16). Significant increases of varistor voltages have been achieved by adding 0.05 mol % of the above-mentioned oxides of rare earth elements in comparison with the comparative example to which any oxide of rare earth element has not been added. It is, therefore, clarified that the minimum content of the oxides of rare earth elements is 0.05 mol % (Examples 1, 5, 9 and 13). On the other hand, when more than 1.0 mol % of the oxide of rare earth element is added, the value of $V_{3\ mA}$ becomes larger, and the oxide grains which contain R (rare earth element), Bi and/or Sb and are created between or inside of crystal grains of zinc oxide increase. As a result, the energy bearing capacities of the resultant sintered samples decrease. For that reason, the content of these oxides of rare earth elements should be within a range of 0.05–1.0 mol %.

TABLE 1

| | Rare Earth Species | Content (mol %) | $V_{3mA}$/mm (V/mm) |
|---|---|---|---|
| Comparative Example 1 | None | 0 | 385 |
| Example 1 | $Y_2O_3$ | 0.05 | 390 |
| Example 2 | | 0.3 | 398 |
| Example 3 | | 0.5 | 411 |
| Example 4 | | 1.0 | 462 |
| Example 5 | $Ho_2O_3$ | 0.05 | 405 |
| Example 6 | | 0.3 | 418 |
| Example 7 | | 0.5 | 431 |
| Example 8 | | 1.0 | 455 |
| Example 9 | $Er_2O_3$ | 0.05 | 395 |
| Example 10 | | 0.3 | 404 |
| Example 11 | | 0.5 | 416 |
| Example 12 | | 1.0 | 438 |
| Example 13 | $Yb_2O_3$ | 0.05 | 402 |
| Example 14 | | 0.3 | 414 |
| Example 15 | | 0.5 | 429 |
| Example 16 | | 1.0 | 450 |

Figure 2:
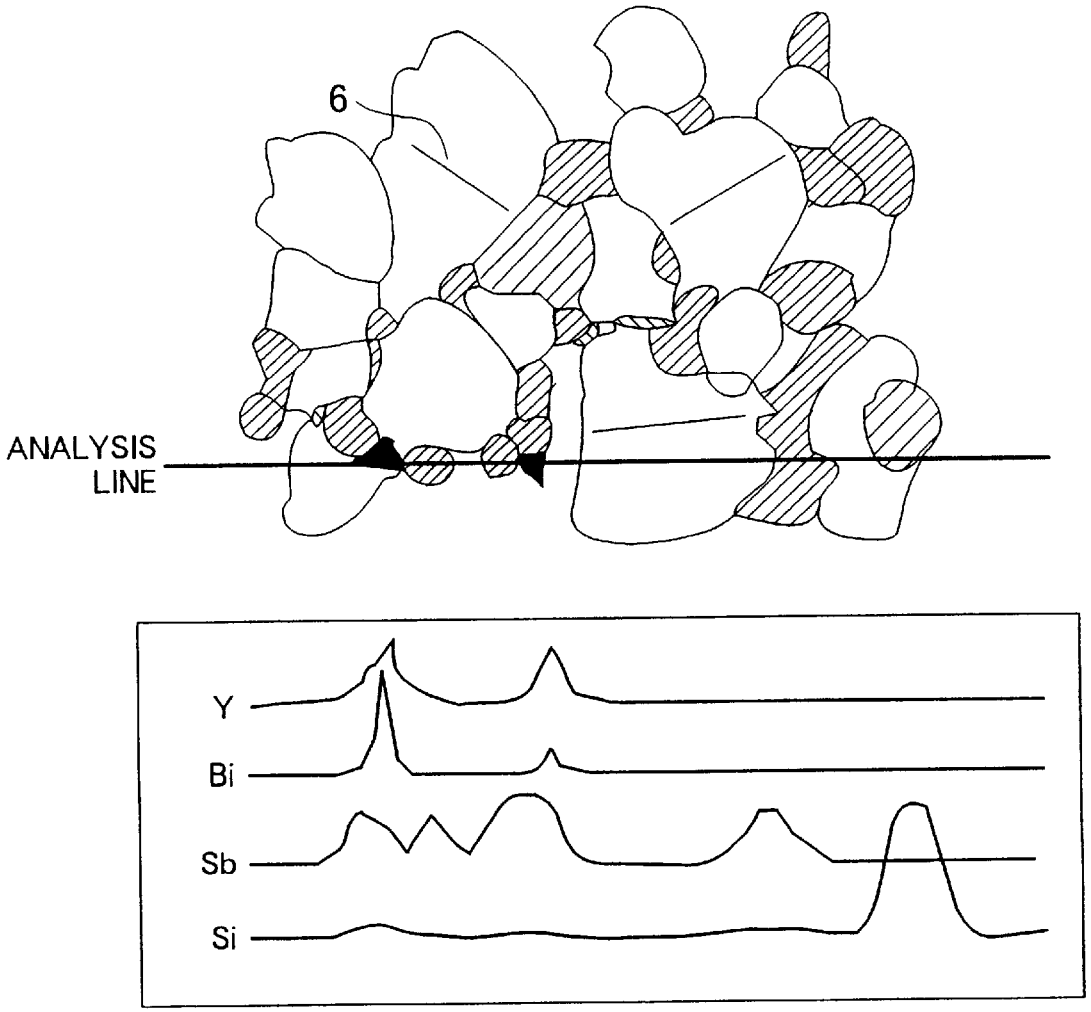
FIG. 2 is a schematic diagram illustrating the results of EPMA linear analysis on the crystal structure of a voltage-dependent non-linear resistor member in relation to the Examples of the present invention.
Figure 3:
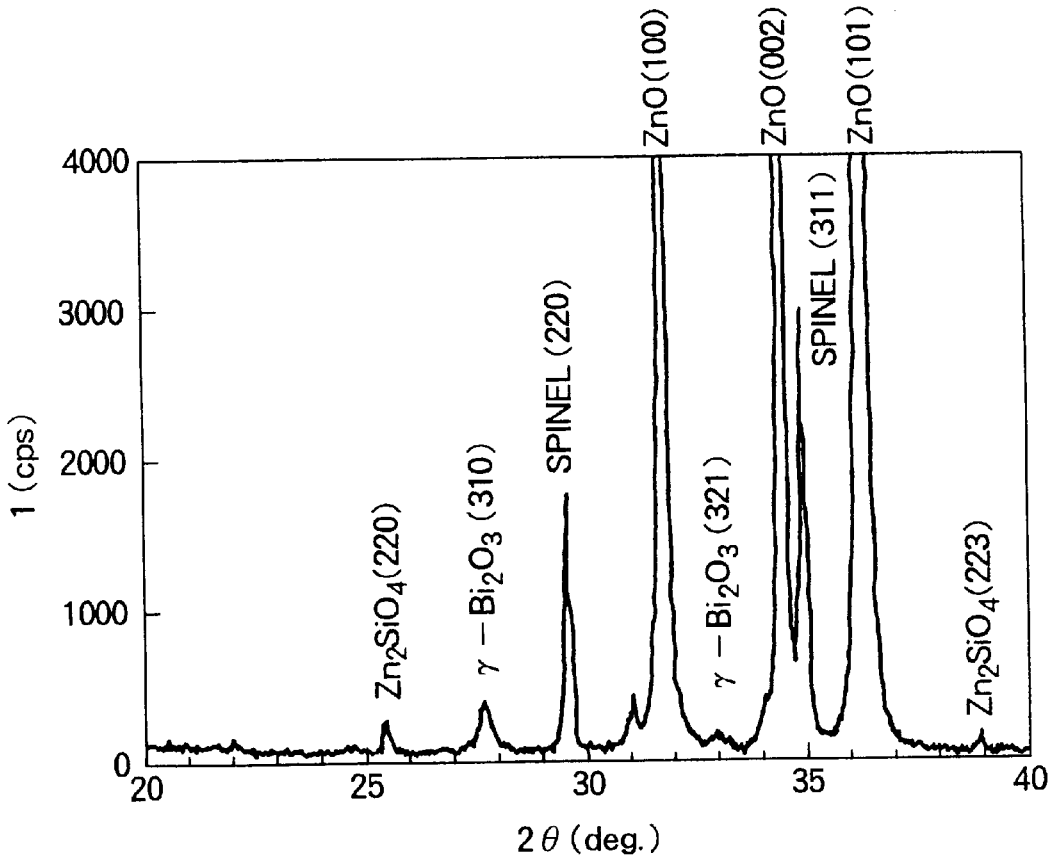
FIG. 3 is a schematic diagram illustrating the results of a X-ray diffractometry on a voltage-dependent non-linear resistor member in relation to the Examples of the present invention.

As shown in FIG. 1, existence of an oxide phase comprising the added rare earth element (R)-bismuth-antimony, and existence of $Zn_2SiO_4$ grains were confirmed besides the existence of spinel phase principally comprising a ZnO crystal, zinc and antimony, from the observation of the crystal structure of each sample which has the same composition as the example shown in Table 1 by using SEM (Scanning Electron Microprobe), EPMA (Electron Probe Analysis), XRD (X-ray Diffractometry), and so forth. The rare earth elements may be classified broadly into three groups, namely, into a group of rare earth elements the addition of which result in increased varistor voltages, a group of rare earth elements by the addition of which varistor voltage does not increase, and a group of rare earth elements the addition of which result in varistor voltage values intermediate of the above two groups. Among those, ten rare earth elements, i.e. Y. Eu, Gd, Tb, Dy, Ho, Er, Tm, Yb and Lu provide increased varistor voltages, while La does not provide an increased varistor voltage, and four rare earth elements, i.e. Ce, Pr, Nd and Sm provide intermediately increased varistor voltages (c.f. the Japanese Patent Application No. 6-250670). The addition of a rare earth elements which provides an increased varistor voltage such as Y or the like results in a resultant sintered body having a crystal structure different from that of the sintered body obtained by adding any of the other types of the rare earth elements. The existence of oxide phase comprising rare earth element (R)-bismuth-antimony, and the existence of $Zn_2SiO_4$ phase can be pointed out as an event which can be observed commonly in the crystal structure of any sintered body obtained by adding a rare earth element capable of providing an increased varistor voltage. FIG. 2 shows the results of EPMA linear analysis on a sample prepared with addition of Y. Coexistence of three elements, Y, Bi and Sb can be clearly confirmed. FIG. 3 shows analytic results of X-ray diffractometry on a sample prepared with the addition of Y. From the results, existence of $Zn_2SiO_4$ grains in the crystal structure can be necessarily affirmed. This can be confirmed also from the results of EPMA areal analysis on the sample prepared with the addition of Y, and the results of EPMA linear analysis, as shown in FIG. 2. Specifically, the existence of Zn in a density relatively lower than the surrounding crystal grains of zinc oxide can be confirmed besides the existence of Si by EPMA areal analysis on the crystal grains in which existence of Si has been confirmed by EPMA linear analysis. The crystal grains of $Zn_2SiO_4$ have approximate diameters of 3–4 μm. It is known that varistor phenomenon occurs at the grain boundaries in zinc oxide varistors, and the varistor voltage per grain boundary is almost constant around 2–3 V regardless of its composition and manufacturing conditions, and therefore, varistor voltage per unit length is in inverse proportion to the average grain size of ZnO crystals (Reference 1). Accordingly, the fact that Y, Eu, Gd, Tb, Dy, Ho, Er, Tm, Yb and Lu increase the varistor voltages indicates that they have effects to inhibit granular growth of ZnO crystals, and actually, these inhibitory effects can be confirmed by examination of the average grain size of ZnO crystals. Totally considering the above, the oxide phase comprising rare earth element (R)-bismuth-antimony and $Zn_2SiO_4$ phase, which can be commonly observed only in the samples prepared with the addition of Y, Eu, Gd, Tb, Dy, Ho, Er, Tm, Yb or Lu, are regarded as having a close relationship with the inhibitory effect against granular growth of the crystal.

Figure 4:
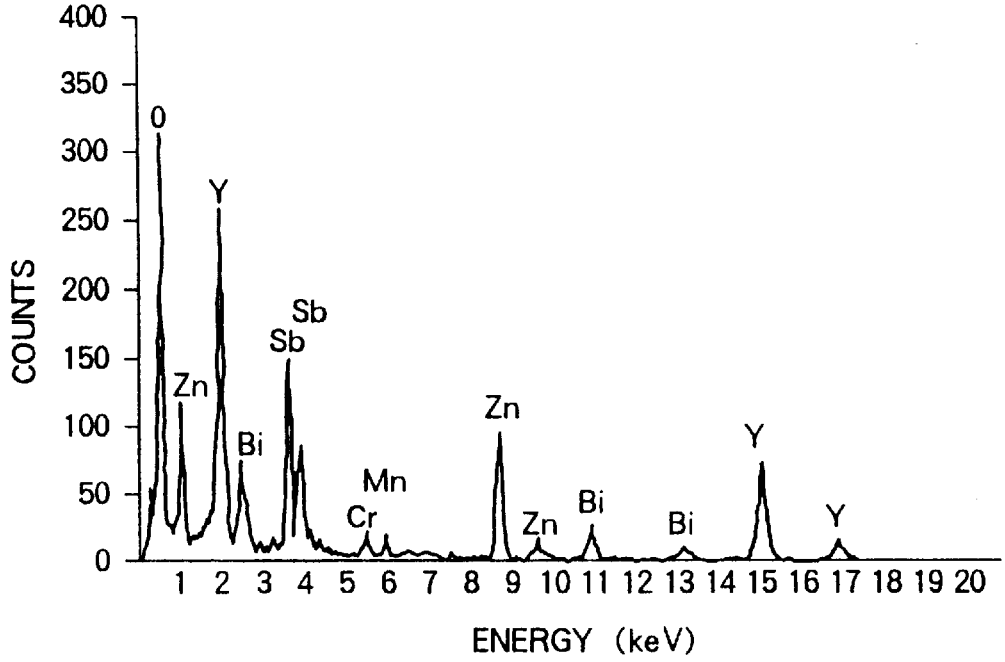
FIG. 4 shows the results of EDS analysis on the crystal phase containing rare earth elements, which exists between or inside of crystal grains of zinc oxide in a voltage-dependent non-linear resistor member according to an example of the present invention.

An EDS pattern at a grain boundary phase comprising a rare earth element was obtained as shown in FIG. 4, by observation and analysis of the crystal structure of the sample which has any one of the compositions of Examples 1–16 as shown in Table 1 by using a transmission electron microscopy (TEM) provided with EDS (Energy Dispersive X-ray Spectroscopy). Table 2 shows the gathered results obtained by analysis at four similar grain boundary phases. From the results, these phases have been found to be oxide phases comprising five elements, i.e. R, Bi, Sb, Zn and Mn. From the average content of each component element and 3 σ value which were statistically determined from the results of quantitative analysis performed at four analysis points, those phases have been found to have compositions of 20.7–39.3, 4.8–10.8, 24.8–33.2, 31.7–40.7, and 0.6–2.0 mol % in terms of $Y_2O_3$, $Bi_2O_3$, $Sb_2O_3$, ZnO, and $MnO_4$, respectively. In fact, a high resolution TEM provided with EDS cannot be substantially applied to analysis on numerous samples. It is then sufficiently reasonable to determine the composition ranges by using analytical values obtained at four analysis points as described above.

TABLE 2

| | | $Y_2O_3$ | $Bi_2O_3$ | $Sb_2O_3$ | ZnO | $Mn_3O_4$ | |
|---|---|---|---|---|---|---|---|
| Analytical Value (%) | 1 | 34.45 | 8.12 | 33.94 | 20.81 | 2.67 | EDS Value[1)] |
| | | 28.74 | 6.77 | 28.30 | 34.71 | 1.48 | Converted Value[2)] |
| | 2 | 26.09 | 10.04 | 38.39 | 23.87 | 1.60 | EDS Value[1)] |
| | | 21.17 | 8.14 | 31.12 | 38.71 | 0.86 | Converted Value[2)] |
| | 3 | 30.42 | 11.20 | 34.24 | 21.33 | 2.37 | EDS Value[1)] |
| | | 25.33 | 9.33 | 28.51 | 35.52 | 1.31 | Converted Value[2)] |
| | 4 | 34.47 | 8.38 | 33.15 | 21.55 | 2.43 | EDS Value[1)] |
| | | 28.56 | 6.94 | 27.46 | 35.70 | 1.34 | Converted Value[2)] |
| Statistical Value | Average | 30.0 | 7.8 | 29.0 | 36.2 | 1.3 | |
| | σ | 3.1 | 1.0 | 1.4 | 1.5 | 0.2 | |
| | 3σ | 9.3 | 3.0 | 4.2 | 4.5 | 0.7 | |

[1)]: Composition by atomic contents. As to EDS values, each total value is not necessarily 100% because there may be 1% or less of detected elements other than the listed elements.
[2)]: Composition in terms of $Y_2O_3$, $Bi_2O_3$, $Sb_2O_3$, ZnO, $Mn_2O_4$, respectively.
[3)]: As to statistic values, the composition in terms of $Y_2O_3$, $Bi_2O_3$, $Sb_2O_3$, ZnO, $Mn_2O_4$ is shown.

Examples 17–19

As is shown in Table 3, 0.0001–0.01 mol % of $Al(NO_3)_3$ and 0.2 mol % of $Er_2O_3$ were added to the basic composition and the resultants were burned to obtain samples. Two step burning was employed, namely, as the first step, a burning was performed on exposure to air, the burning in which is excellent in homogeneity and mass-productivity, and then, the second burning step was performed in an oxygen atmosphere in order to enhance non-linearity. The second burning step in an oxygen atmosphere was carried out according to FIG. 5, wherein the annealing during 600–500 was done at a descending gradient of 1/hour. In Examples 17–19, it was clarified that the flatness ratio in the large-current region, $V_{10\ kA}/V_{3\ mA}$ decreased, namely, markedly improved according to an increase of the Al content. With an Al content of 0.001 mol % or less, the flatness ratio in the large-current region, $V_{10\ kA}/V_{3\ mA}$ increased, namely, markedly deteriorated, such as in Examples 2 and 3. On the other hand, the flatness ratio in the small-current region, $V_{3\ mA}/V_{10\ \mu A}$ increased according to an increase of the Al content, and markedly deteriorated with a content of more than 0.01 mol %. The Al content should, therefore, necessarily be 0.001–0.01 mol % in terms of $Al(NO_3)_3$.

TABLE 3

| | Content of Rare Earth Element (mol %) | Content of $Al(NO_3)_3$ (mol %) | $V_{3mA}/V_{10\mu A}$ | $V_{10kA}/V_{3mA}$ |
|---|---|---|---|---|
| Comparative Example 2 | $Er_2O_3$ 0.2 | 0.0001 | 1.128 | 1.997 |
| Comparative Example 3 | | 0.0005 | 1.204 | 1.756 |
| Example 17 | | 0.001 | 1.451 | 1.677 |
| Example 18 | | 0.004 | 1.643 | 1.525 |
| Example 19 | | 0.01 | 1.957 | 1.482 |

Examples 20–28

Burning in an oxygen atmosphere was employed in order to reduce leakage current and elongate the life span of the samples produced with the addition of Y, Ho, Er or Yb, and the burning condition was examined. Based on the temperature profile shown in FIG. 5, the dwell temperature and dwell time in the heat retaining process of the temperature descending process was examined using samples produced by adding 0.3 mol % of an oxide of a rare earth element, $Ho_2O_3$ to the basic composition. The content of aluminum was 0.002 mol % in terms of its nitrate aqueous solution. According to the above-described grounds, two step burning was employed, namely, in the first step, burning was performed on exposure to air, the burning in which is excellent in homogeneity and mass-productivity, and then, the second burning step was performed in an oxygen atmosphere in order to enhance non-linearity. The following is a description with some examples about the conditions for the second burning step which is to be carried out in an oxygen atmosphere.

From the results as to Comparative Examples 4–8 and Examples 20–26, shown in Table 4, it is obvious that the flatness ratio in the small-current region ($V_{3\ mA}/V_{10\ \mu A}$), which is closely related to leakage current, is minimum when heat retaining is performed at 500–550° C. Further, it is suggested from the results as to Comparative Example 4 and Examples 27 and 28 that about 40 hours is required as the dwell time for the heat retaining at 500° C. Here, 100 hours or more is required in order to achieve an equilibrium state.

TABLE 4

| | Dwell Temperature (° C.) | Dwell Time (hour) | $V_{3mA}$/mm (V/mm) | $V_{3mA}/V_{10\mu A}$ | $V_{10kA}/V_{3mA}$ |
|---|---|---|---|---|---|
| Comparative Example 4 | No Heat Retaining | 0 | 407 | 2.801 | 1.510 |
| Comparative Example 5 | 900 | 40 | 440 | 2.603 | 1.535 |
| Comparative Example 6 | 800 | 40 | 437 | 2.540 | 1.502 |
| Comparative Example 7 | 750 | 40 | 430 | 2.545 | 1.480 |
| Example 20 | 700 | 40 | 430 | 2.496 | 1.474 |
| Example 21 | 650 | 40 | 426 | 2.271 | 1.462 |
| Example 22 | 600 | 40 | 423 | 1.972 | 1.452 |
| Example 23 | 550 | 40 | 424 | 1.860 | 1.650 |
| Example 24 | 500 | 40 | 424 | 1.865 | 1.476 |
| Example 25 | 450 | 40 | 418 | 2.032 | 1.490 |
| Example 26 | 400 | 40 | 410 | 2.236 | 1.507 |
| Comparative Example 8 | 300 | 40 | 402 | 2.494 | 1.527 |
| Example 27 | 500 | 40 | 424 | 1.865 | 1.476 |
| Example 28 | 500 | 100 | 428 | 1.593 | 1.472 |

Examples 29–37

In industry, especially in continuous furnaces, it is preferable to set an annealing zone rather than a heat retaining zone. Table 5 shows the results obtained when annealing was carried out between 700–500° C. in a temperature profile similar to that shown in FIG. 5. In each group of the samples produced with the addition of Yb, Ho or Er, though the flatness ratio in the small-current region ($V_{3\ mA}/V_{10\ \mu A}$) is small at a descending temperature gradient of 1–5° C./hour, it increases according to an increase of the gradient. Especially with a descending temperature gradient of more than 5° C./hour, $V_{3\ mA}/V_{10\ \mu A}$ exhibits a remarkable increasing tendency. From the results, it is concluded that the descending temperature gradient should be 5° C./hour or less, preferably 2.5° C./hour or less.

The content of aluminum was 0.002 mol % as its nitrate aqueous solution.

TABLE 5

| | Temperature Descending Gradient ° C./hour | Content of Rare Earth Species mol % | $V_{3mA}/V_{10\mu A}$ | $V_{10kA}/V_{3mA}$ |
|---|---|---|---|---|
| Example 29 | 1.0 | $Yb_2O_3$ 0.3 | 1.351 | 1.452 |
| Example 30 | 2.5 | | 1.476 | 1.459 |
| Example 31 | 5.0 | | 1.714 | 1.493 |

TABLE 5-continued

| | Temperature Descending Gradient ° C./hour | Content of Rare Earth Species mol % | $V_{3mA}/V_{10\mu A}$ | $V_{10kA}/V_{3mA}$ |
|---|---|---|---|---|
| Comparative Example 9 | 10.0 | | 2.102 | 1.651 |
| Example 32 | 1.0 | $Ho_2O_3$ 0.3 | 1.390 | 1.431 |
| Example 33 | 2.5 | | 1.482 | 1.433 |
| Example 34 | 5.0 | | 1.674 | 1.474 |
| Comparative Example 10 | 10.0 | | 2.042 | 1.615 |
| Example 35 | 1.0 | $Er_2O_3$ 0.3 | 1.351 | 1.442 |
| Example 36 | 2.5 | | 1.433 | 1.429 |
| Example 37 | 5.0 | | 1.610 | 1.466 |
| Comparative Example 11 | 10.0 | | 2.015 | 1.560 |

Examples 38–41

When burning is performed in an oxygen atmosphere, a condition of 100% oxygen partial pressure is rarely achieved especially in continuous furnaces. Using a box type electric furnace which can precisely control oxygen partial pressure, the permissible range of the oxygen partial pressure for the second burning in an oxygen atmosphere was examined on samples produced with the addition of 0.3 mol % of $Yb_2O_3$. Table 6 shows the results of the examination performed in a temperature profile similar to that shown in FIG. 5. Here, the conditions of heat retaining in the temperature descending region were predetermined to be 700° C. for 20 hours. In case where the partial pressure of oxygen is determined, the remaining gas component is principally nitrogen. The values of the varistor voltage and flatness ratio in the small-current region ($V_{3\ mA}/V_{10\ \mu A}$) are shown, while the flatness ratio in the large-current region ($V_{10\ kA}/V_{3\ mA}$) exhibits only a slight change as compared with the flatness ratio in the small-current region. The varistor voltage slightly decreased according to an increase of $V_{3\ mA}/V_{10\ \mu A}$. This can be understood as being attributed to the change of voltage-current characteristic in the small-current region. Accordingly, it is obvious that the oxygen partial pressure is effective mainly in improvement of the flatness ratio in the small-current region. In view of the difference between $V_{3\ mA}/V_{10\ \mu A}$ values obtained by setting the oxygen partial pressure at 20% and 100%, setting the oxygen partial pressure at 50% has been found to achieve two-thirds of the maximum $V_{3\ mA}/V_{10\ \mu A}$-improving-effect by using oxygen atmosphere. Consequently, the oxygen partial pressure should be 50% or more, and preferably, 80% or more.

The content of aluminum was 0.002 mol % as its nitrate aqueous solution.

TABLE 6

| | Oxygen Partial Pressure (%) | $V_{3mA}$/mm (V/mm) | $V_{3mA}/V_{10\mu A}$ |
|---|---|---|---|
| Example 38 | 100 | 439 | 1.843 |
| Example 39 | 90 | 439 | 1.865 |
| Example 40 | 80 | 437 | 1.893 |
| Example 41 | 50 | 433 | 1.968 |
| Comparative Example 12 | 20 | 422 | 2.145 |

Examples 42–46

The arresters for various voltage system in small size in compared to those equipped with the conventional voltage-dependent non-linear resister members by introducing the members described above or obtained from the method set forth in the above into the arresters. Table 7 and FIGS. 9 to 13 show sizes of some arresters for various voltage system. The improvements of the protective properties of the arrester correspond to that of the non-linearity of the members described in Examples.

Table 7 shows comparisons outer dimension with the volume of the conventional and the present arresters for various voltages. Con. means the conventional arrester equipped with the conventional voltage-dependent non-linear resister member. Further, Pre. means the arrester of the present invention equipped with the member of the present invention. The upper site in outer dimension column represents diameters and the lower site, heights. The arresters of the present invention have outer dimensions smaller than those of the conventional arresters in each voltage. Further, the volume ratio of the present arresters to the conventional are 0.41 to 0.68, indicating that the present arresters have very small size in compared to the conventional arresters.

TABLE 7

| transmission | 1000 kV | | 500 kV | | 275 kV | |
|---|---|---|---|---|---|---|
| sys. | Con. | Pre. | Con. | Pre. | Con. | Pre. |
| Outer dimension (mm) | ϕ1774 × 4800 | ϕ1550 × 4300 | ϕ1018 × 2580 | ϕ932 × 1550 | ϕ768 × 1800 | ϕ660 × 1000 |
| Volume ratio | 1.0 | 0.68 | 1.0 | 0.50 | 1.0 | 0.41 |
| transmission | 154 kV | | 110 kV | | 66 kV | |
| sys. | Con. | Pre. | Con. | Pre. | Con. | Pre. |
| Outer dimension (mm) | ϕ1100 × 1635 | ϕ818 × 1600 | ϕ618 × 1655 | ϕ618 × 1150 | ϕ542 × 1283 | ϕ508 × 733 |
| Volume ratio | 1.0 | 0.54 | 1.0 | 0.69 | 1.0 | 0.50 |

Figure 9:
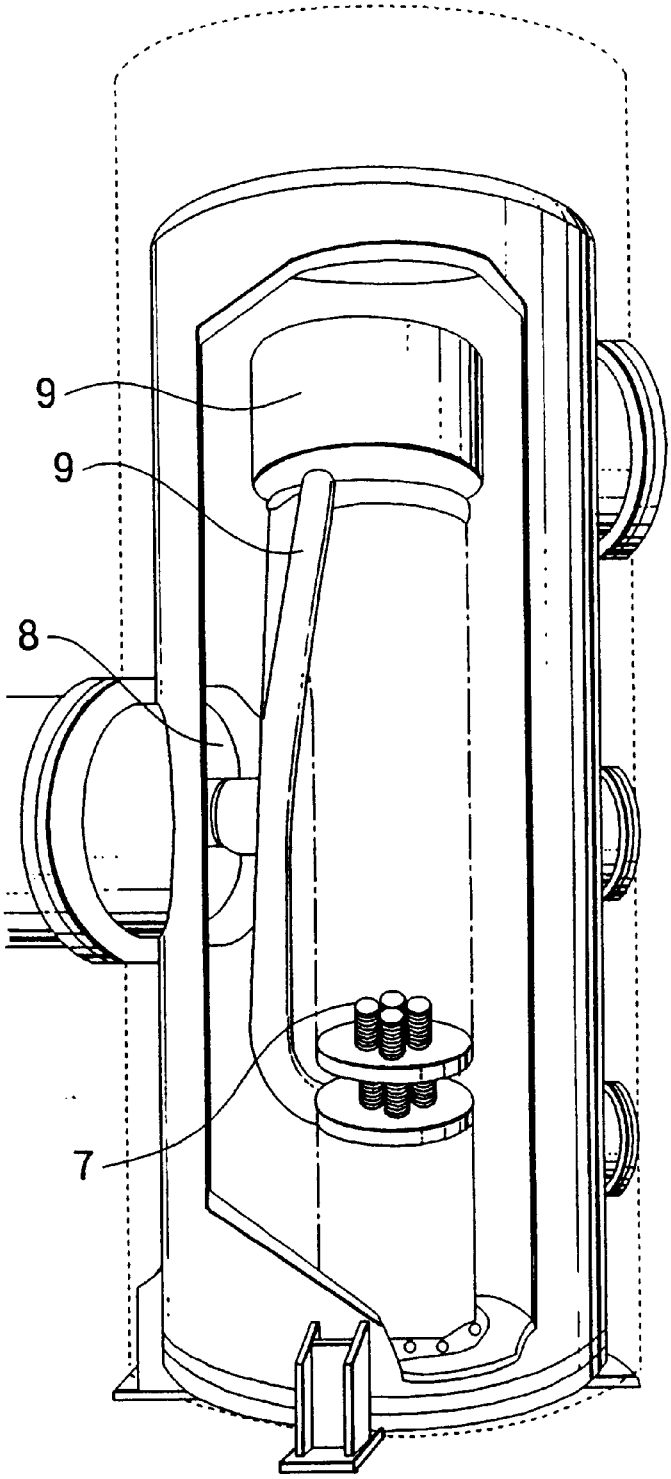
FIG. 9 is a schematic view of an embodiment of an arrester of the present invention.

FIG. 9 shows a schematic view of 1000 kV arrester in Example 42 of the present invention. Numeral indicates voltage-dependent non-linear resistor member, 8, spacer, 9, shield. The dot line represents the outer dimension of the conventional 1000 kV arrester.

Figure 10:
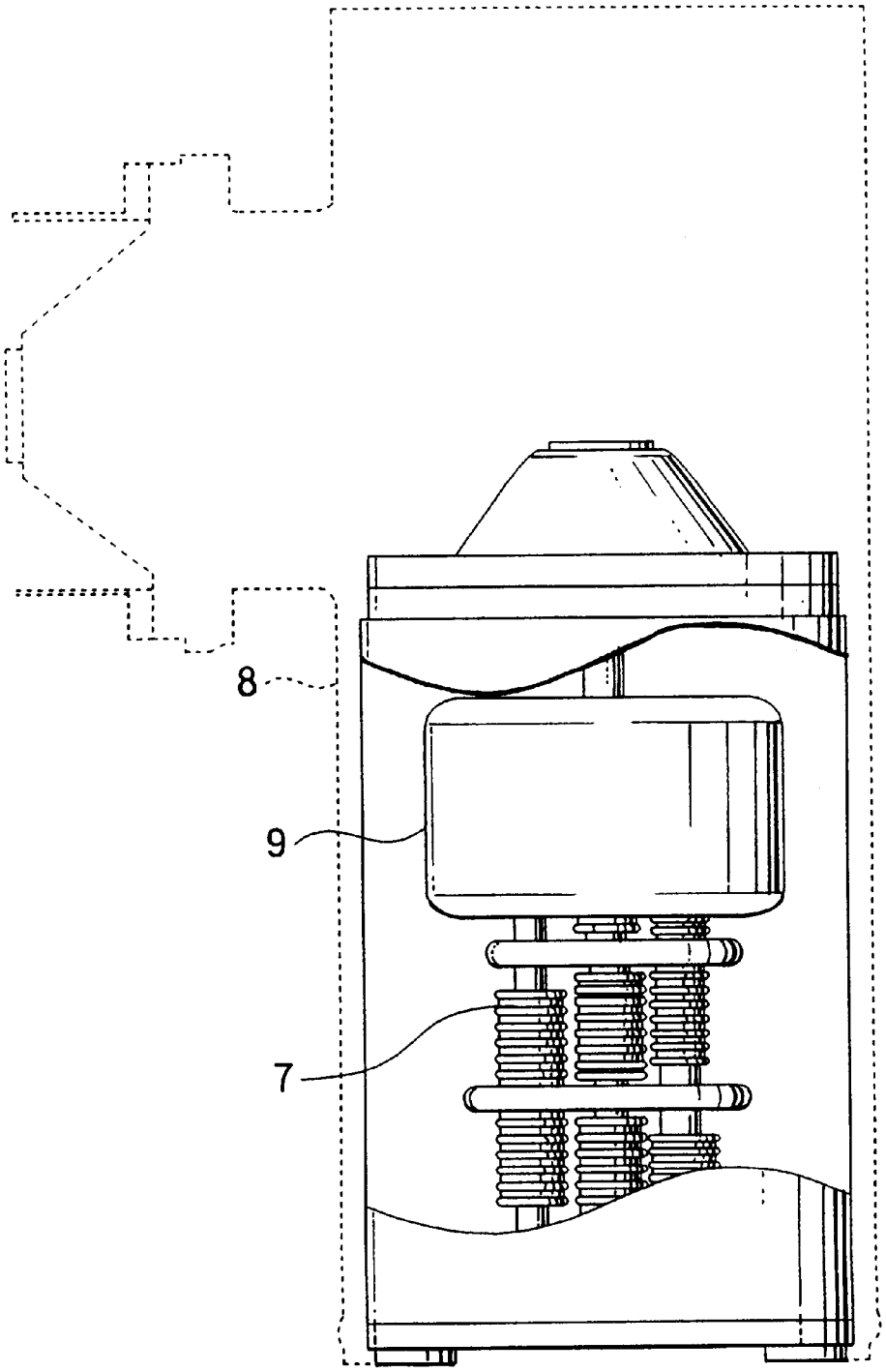
FIG. 10 is a schematic view of another embodiment of an arrester of the present invention.

FIG. 10 shows a schematic view of 500 kV arrester in Example 43 of the present invention. The dot line represents the outer dimension of the conventional 500 kV arrester. Numeral 7 indicates voltage dependent non-linear resistor member.

Figure 11:
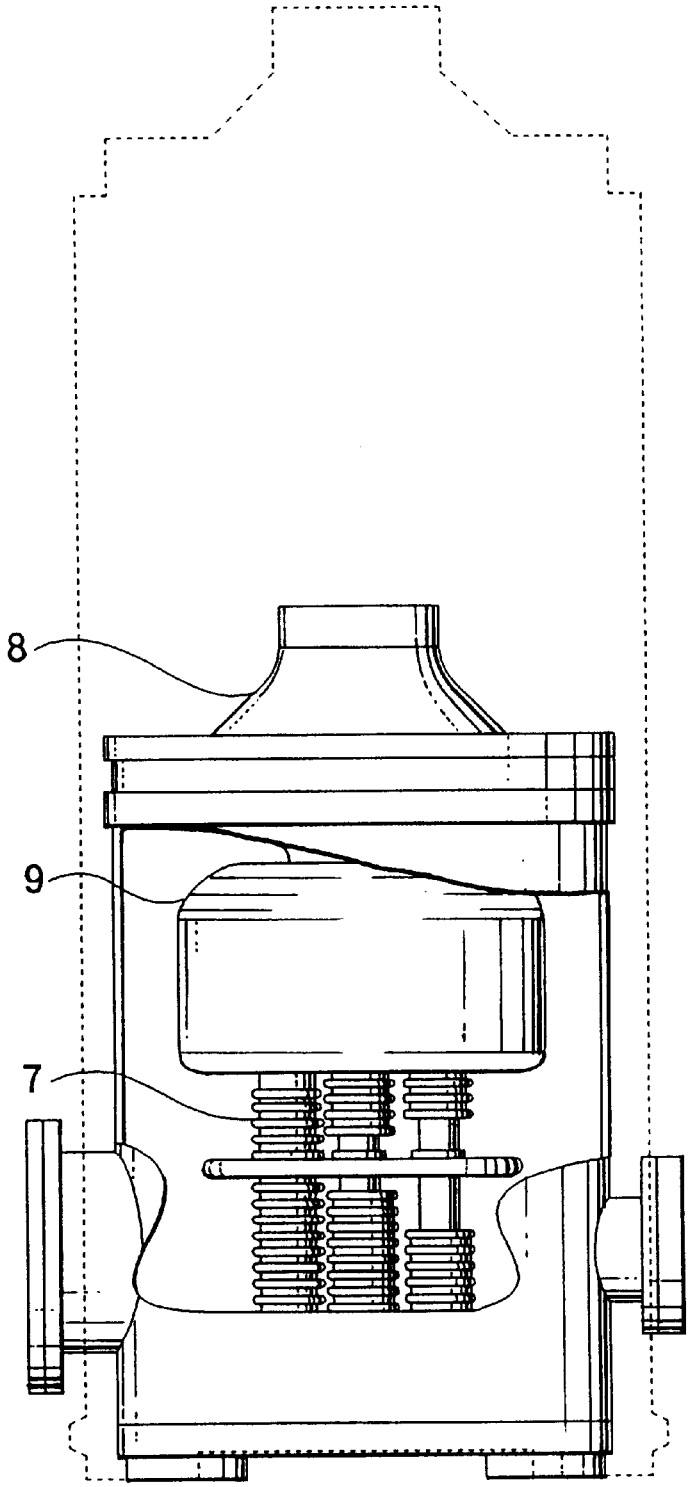
FIG. 11 is a schematic view of another embodiment of an arrester of the present invention.

FIG. 11 shows a schematic view of 275 kV arrester in Example 44 of the present invention. The dot line represents the outer dimension of the conventional 275 kV arrester. Numeral indicates voltage dependent non-linear resistor member.

Figure 12:
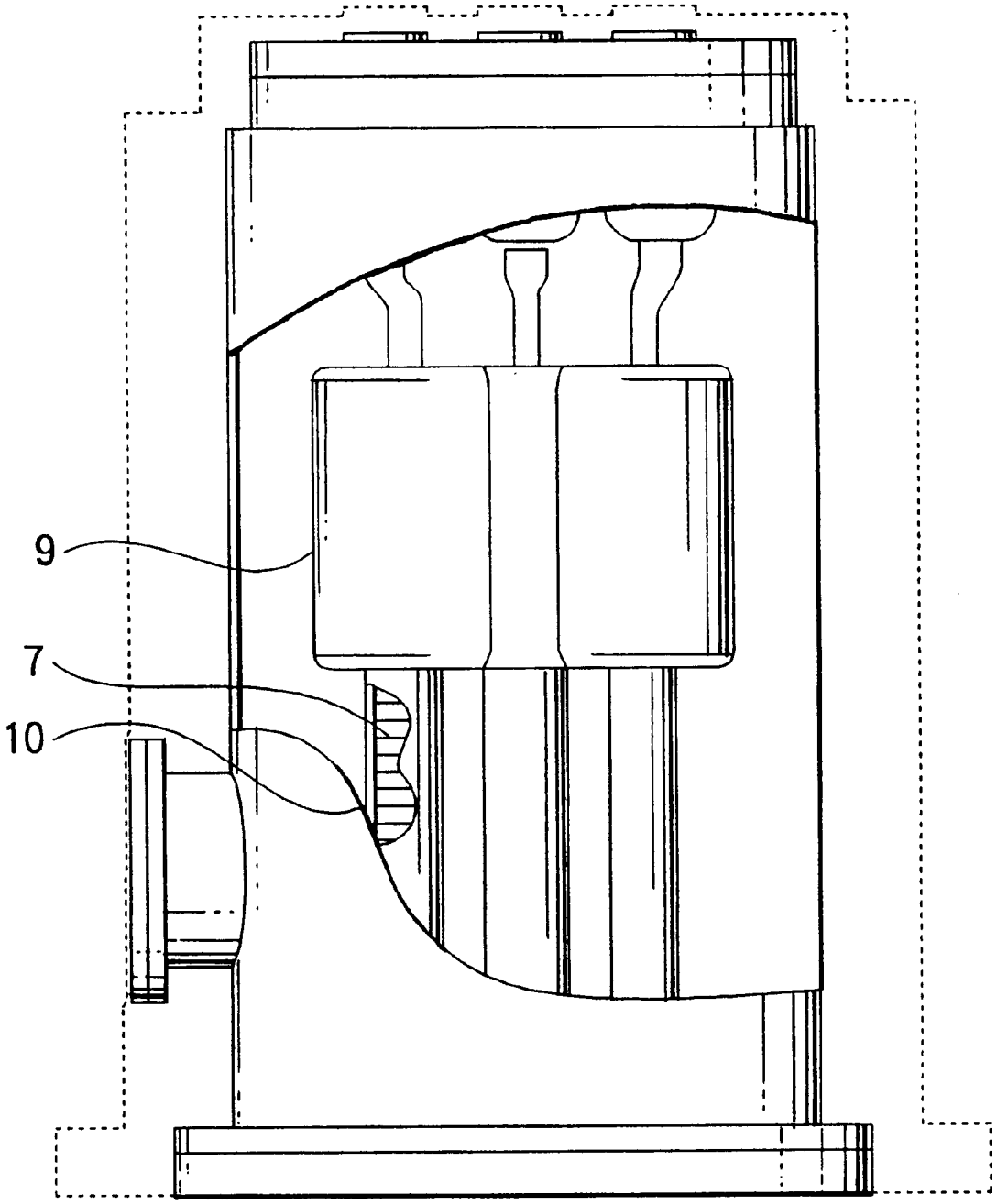
FIG. 12 is a schematic view of another embodiment of an arrester of the present invention.

FIG. 12 shows a schematic view of 154 kV arrester in Example 45 of the present invention. The dot line represents the outer dimension of the conventional 154 kV arrester. Numeral 7 indicates voltage dependent non-linear resistor member, 10, insulating pipe.

Figure 13:
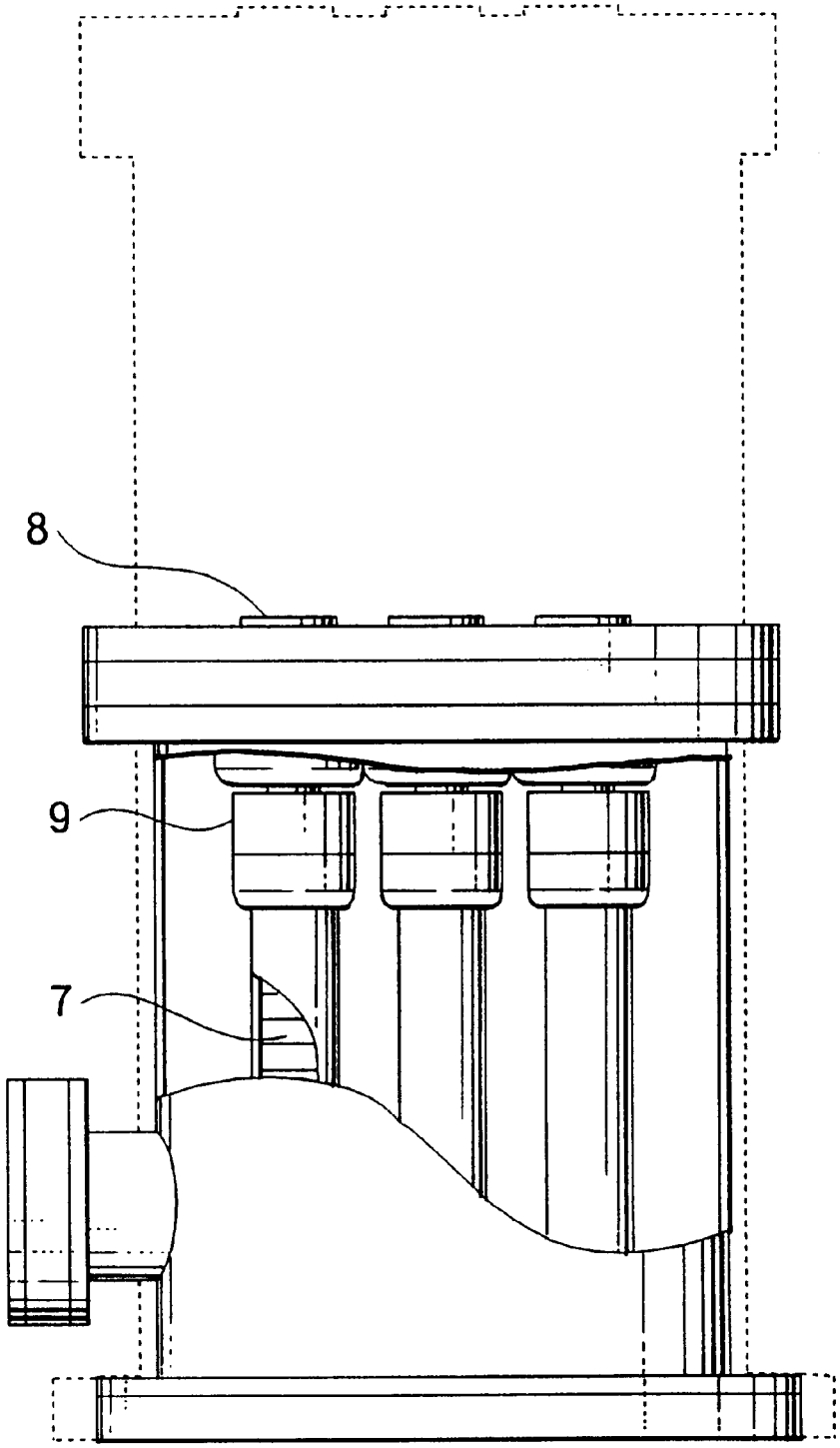
FIG. 13 is a schematic view of another embodiment of an arrester of the present invention.

FIG. 13 shows a schematic view of 66/77 kV arrester in Example 46 of the present invention. The dot line represents the outer dimension of the conventional 66/77 kV arrester. Numeral 7 indicates voltage dependent non-linear resistor member.

On the basis of the present invention, grain sizes of zinc oxide can be finer by addition of an oxide of a rare earth element, and thus, a voltage-dependent non-linear resistor device having a large varistor voltage can be obtained. Further, a voltage-current non-linearity with an improvement in the flatness ratio in the large-current region can be achieved by adjusting the content of $Al_2O_3$. Moreover, in relation to burning conditions, a voltage-dependent non-linear resistor member which is improved in both the flatness ratios in the large-current region and the small-current region can be obtained by performing the first burning step on exposure to air, and subsequent second burning step, wherein an annealing process at a temperature descending gradient predetermined within a range, or a heat retaining process at a constant temperature is provided for the temperature descending zone of the second burning step, and wherein the annealing process or heat retaining process is performed in an oxygen atmosphere.

Use of this voltage-dependent non-linear resistor member makes it possible, for example, to improve the protective performance of an arrestor, and to miniaturize the same.

The voltage-dependent non-linear resistor member according to the first aspect of the present invention comprises a composition which principally consists of zinc oxide and contains bismuth oxide, and at least one oxide of a rare earth element R selected from Y, Ho, Er and Yb which is to be added to the composition in an amount of 0.05–1.0 mol % in terms of $R_2O_3$, wherein the composition is burned subsequent to the addition. The resistor member thus obtained has a small average grain size of zinc oxide grains and a small resistivity in the crystal grain of zinc oxide, and as a result, the varistor voltage is large and the flatness ratio in the large-current region, $V_H/V_S$ is improved.

The voltage-dependent non-linear resistor member according to the second aspect of the present invention further comprises Al which is to be added to the composition in an amount of 0.0005–0.005 mol % in terms of $Al_2O_3$. The resistor member thus obtained has a small average grain size of zinc oxide grains and a small resistivity in the crystal grain of zinc oxide, and as a result, the varistor voltage is large and the flatness ratio in the large-current region, $V_H/V_S$ is further improved.

The voltage-dependent non-linear resistor member according to the third aspect of the present invention comprises a sintered material produced by burning a composition which principally consists of zinc oxide, contains bismuth oxide and is further mixed with Sb and Si, subsequent to addition of at least one oxide of a rare earth element R selected from Y, Ho, Er and Yb in an amount of 0.05–1.0 mol % in terms of $R_2O_3$. Since the sintered material has oxide grains composed of R (rare earth element), Bi and Sb, and crystal grains of zinc silicate, $Zn_2SiO_4$, the granular growth of zinc oxide grains is inhibited and the average grain size is restricted to a small value. As a result, the varistor voltage would be large and the properties are improved.

The voltage-dependent non-linear resistor member according to the fourth aspect of the present invention comprises a sintered material produced by burning a composition which principally consists of zinc oxide, contains bismuth oxide and is further mixed with Sb, Si and Mn, subsequent to addition of at least one oxide of a rare earth element R selected from Y, Ho, Er and Yb in an amount of 0.05–1.0 mol % in terms of $R_2O_3$. Since the sintered material has oxide grains composed of R (rare earth element), Bi, Sb, Zn and Mn, and crystal grains of zinc silicate, $Zn_2SiO_4$, the granular growth of zinc oxide grains is inhibited and the average grain size is restricted to a small value. As a result, the varistor voltage would be large and the properties are improved.

The voltage-dependent non-linear resistor member according to the fifth aspect of the present invention is the above voltage-dependent non-linear resistor member, wherein the composition of the oxide grains respectively composed of R (rare earth element), Bi, Sb, Zn and Mn is 20.7–39.3, 4.8–10.8, 24.8–33.2, 31.7–40.7, 0.6–2.0 mol %, in terms of $Y_2O_3$, $Bi_2O_3$, $Sb_2O_3$, ZnO, $Mn_3O_4$, respectively. As it is, the granular growth of zinc oxide grains is inhibited and the average grain size is restricted to a small value. As a result, the varistor voltage would be large and the properties are improved.

According to the method of the present invention for producing the voltage-dependent non-linear resistor member, comprising conducting first burning of the member and conducting second burning of the resultant, wherein the first burning step on exposure to air, and a subsequent annealing process with a temperature descending gradient predetermined at 5° C./hour or less or a heat retaining process at a constant temperature is contained, and further, the annealing process or heat retaining process is performed in an atmosphere of 50 vol % or more of oxygen partial pressure. By means of that, a voltage-dependent non-linear resistor member which is improved in both the flatness ratios in the large-current region and the small-current region can be obtained.

The arrester of the present invention has a small size and the improved protective properties since the above member is applied.

Further, the arrester of the present invention can be obtain by the method comprising conducting first burning of the member and conducting second burning of the resultant, wherein the first burning step on exposure to air, and a subsequent annealing process with a temperature descending gradient predetermined at 5° C./hour or less or a heat retaining process at a constant temperature is contained, and further, the annealing process or heat retaining process is performed in an atmosphere of 50 vol % or more of oxygen partial pressure. Therefore, the arrester has a small size and the improved protective properties.

What is claimed is:

1. A voltage-dependent non-linear resistor member prepared by a process comprising adding at least one oxide of a rare earth element R selected from Y, Ho, Er and Yb in an amount of 0.05–1.0 mol % in terms of $R_2O_3$ to a composition principally containing zinc oxide and further containing bismuth oxide to form a mixture, and then burning the mixture to form a sintered material including zinc oxide crystal grains, wherein Al is further added to the composition such that $Al_2O_3$ is present in the sintered material in an amount of 0.0005–0.004 mol %, wherein the sintered material is the voltage-dependent non-linear resistor member, and wherein Sb and Si are further added to the composition, and the sintered material includes oxide grains composed of the rare earth element R, Bi and Sb, and crystal grains of zinc silicate, $Zn_2SiO_4$, which exist between or inside of said zinc oxide crystal grains.

2. A voltage-dependant non-linear resistor member prepared by a process comprising adding at least one of a rare earth element R selected from Y, Ho, Er and Yb in an amount of 0.05–1.0 mol % in terms of $R_2O_3$ to a composition principally containing zinc oxide and further containing bismuth oxide to form a mixture, and then burning the mixture to form a sintered material including zinc oxide crystal grains, wherein the sintered material is the voltage-dependant non-linear resistor member, and wherein Sb, Si and Mn are further added to the composition, and the sintered material includes oxide grains composed of the rare earth element R, Bi, Sb, Zn and Mn, and crystal grains of zinc silicate, $Zn_2SiO_4$, which exist between or inside of said zinc oxide crystal grains, and wherein the voltage-dependant non-linear resistor comprises the oxide grains of the rare earth element R, Bi, Sb, Zn and Mn in amounts of 20.7–39.3, 4.8–10.8, 24.8–33.2, 31.7–40.7 and 0.6–2.0 mol %, respectively, of all of the oxide grains in terms of $R_2O_3$, $Bi_2O_3$, $Sb_2O_3$, ZnO and $Mn_3O_4$, respectively.

3. An arrester equipped with the voltage-dependant non-linear resistor member according to claim 2.

4. The voltage-dependent non-linear resistor member according to claim 2 wherein Al is further added such that $Al_2O_3$ is present in the sintered material in an amount of 0.0005–0.004 mol %.

* * * * *